United States Patent [19]

Morrison

[11] Patent Number: 4,753,578

[45] Date of Patent: Jun. 28, 1988

[54] ABRASIVE FLUID PUMPING APPARATUS

[76] Inventor: Donald R. Morrison, 6228 Eagle Peak Dr., Charlotte, N.C. 28214

[21] Appl. No.: 936,479

[22] Filed: Nov. 26, 1986

[51] Int. Cl.[4] ..... F04B 49/00; F04B 43/00

[52] U.S. Cl. ..... 417/308; 417/440; 417/480; 92/90; 92/103 M

[58] Field of Search ..... 417/412, 472, 478, 308, 417/440, 480; 92/34, 90, 97, 103 M

[56] References Cited

U.S. PATENT DOCUMENTS

| | | | |
|---|---|---|---|
| 1,454,886 | 5/1923 | Giesler | 417/472 X |
| 1,554,332 | 9/1925 | Callow | 92/90 |
| 1,711,803 | 5/1929 | Munday | 92/103 M X |
| 1,843,068 | 1/1932 | Von Wangenheim et al. | 92/103 M X |
| 1,893,776 | 1/1933 | Hull | 417/478 |
| 1,927,617 | 9/1933 | Schmidt | 92/103 M X |
| 1,992,139 | 2/1935 | Armstrong | 417/480 |
| 2,204,738 | 6/1940 | Swan | 417/478 X |
| 2,267,280 | 12/1941 | Kühnel | 417/480 X |
| 2,853,024 | 9/1958 | Bruce | 92/103 M X |
| 3,463,397 | 8/1969 | Mecklin et al. | 417/308 X |
| 4,667,069 | 5/1987 | Cholkeri | 92/103 M |

FOREIGN PATENT DOCUMENTS

| | | | |
|---|---|---|---|
| 2567970 | 1/1986 | France | 417/472 |

*Primary Examiner*—Carlton R. Croyle
*Assistant Examiner*—Paul F. Neils
*Attorney, Agent, or Firm*—B. B. Olive

[57] ABSTRACT

A pumping apparatus is formed by a flexible, metal wall structure surrounding and defining a hollow interior chamber and with a mechanism to compress and expand the structure to create a pumping action through an opening to the chamber. The pumping apparatus forms part of an overall system particularly adapted for pumping abrasive liquids.

6 Claims, 4 Drawing Sheets

ABRASIVE FLUID PUMPING APPARATUS

DESCRIPTION

1. Technical Field

The invention relates to pumps and pump systems particularly for handling abrasive fluids.

2. Background Art

The wear and short life problem related to pumping liquids which are abrasive in character is described in U.S. Pat. Nos. 3,931,755 and 4,599,053 both of which patents relate to pumping apparatus for handling abrasive fluids. Gear type as well as piston and diaphragm type pumps have proved inadequate for such purpose. The handling of abrasive fluids also gives rise to a sometimes difficult problem of cleaning when the pumping apparatus is shut down. Many conventional pumps are specifically designed for pumping fluids and are not capable of pumping air for the purpose of cleaning out the hoses, connections and the like during shut-down. While it is well known to use a bellows-type pump made of molded rubber or the like to pump air or oxygen in artificial respirators, such pumps are completely unsuited to the task of pumping abrasive fluids. Thus, there is a need for an improved pumping apparatus specifically adapted to pump abrasive fluids, with a relatively long pump life, which is easy to clean on shutdown, which is easy to prime on startup and which provides means both for return of liquid under excess pressure at all of the pumped liquid to the source of supply to facilitate stirring of the liquid particularly those liquids with substantial solids content. The provision of such apparatus thus becomes a primary object of the invention. Other objects will appear as the description proceeds.

DISCLOSURE OF INVENTION

The pumping apparatus of the invention in the illustrated embodiment incorporates a pump having a hollow chamber with flexible walls made up of thin metallic sheet material. The chamber has a removable bottom plug for draining the chamber of its contents during shutdown and another opening which serves as both an intake and exhaust port during pumping and for priming on start-up. A pumping action is created by flexing the opposed sidewalls of the chamber in and out to create both suction and pressure effects. The pumping chamber is connected through appropriate valves and pipes both to a source of liquid supply and to a spray wand or other device for discharging the pumped liquid. A relief valve arrangement relieves excessive pressure and directs excess liquid back to the source of supply. An alternative manually operated valve controlled flow path enables all of the pumped liquid to return to the source of supply to stir the supply and recirculate.

BEST MODE FOR CARRYING OUT THE INVENTION

Figure 1:
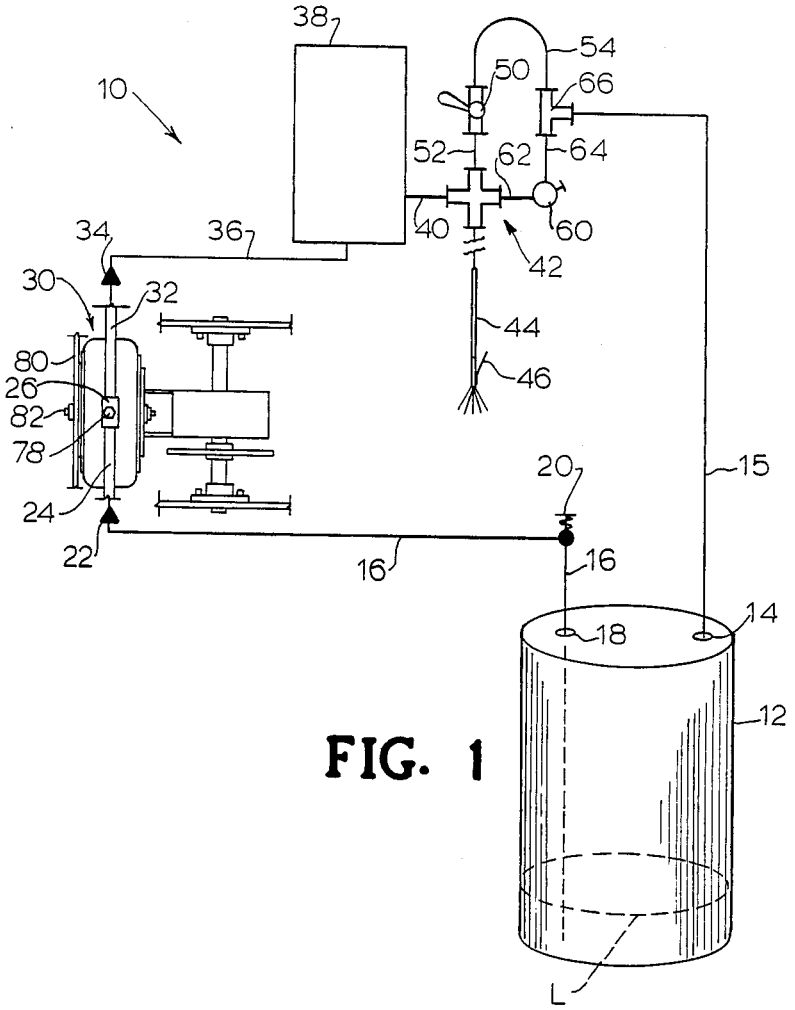
FIG. 1 is a schematic diagram of a barrel type pumping system incorporating the improved pump of the invention.
Figure 2:
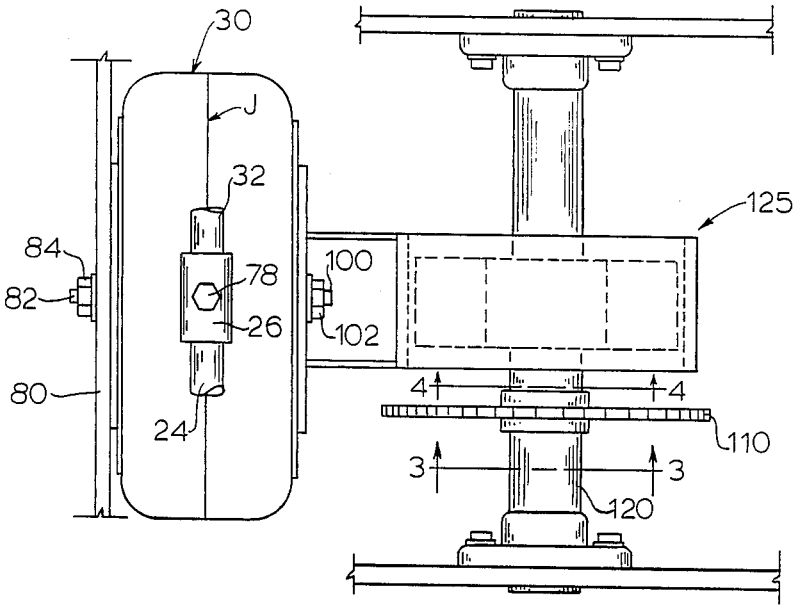
FIG. 2 is a plan view of an apparatus for mounting and driving the invention pump.

Making reference initially to FIG. 1, there is illustrated a pump system 10 having a barrel 12, with a supply of an abrasive or other liquid L to be pumped. Barrel 12 is provided with an opening 14 for receiving liquid L being returned to barrel 12 by a return line or hose 15 loosely inserted in opening 14. A suitable pipe or flexible suction hose forms line 16 which is loosely passed through another opening 18 formed in barrel 12. Suction pipe or hose 16 mounts an adjustable needle controlled air valve 20 and also connects to a one-way valve 22 which permits passage of the liquid L only toward the pump 30. Valve 22 through line 24, tee 26, and line 27 connects to pump 30 which is the principle element of the invention and is later explained in more detail. Pump 30 also connects through line 32 connected to tee 26 to another one-way valve 34 which permits passage of the liquid L only to the connected line 36.

During a suction stroke of pump 30, the abrasive or other liquid L is drawn through line 16, through valve 22, through line 24, tee 25 and line 27 into pump 30. On an exhaust stroke, pump 30 forces fluid from within pump 30 through line 27, tee 26, line 32, one-way valve 34, and line 36 to a conventional accumulator or air pressure tank 38 with the amount of air being drawn into the system being controlled by the setting of the air needle valve 20. While pump 30 is shown with only a single opening through line 27 as a combined intake and discharge port separate intake and discharge ports could be provided. Valve 22 opens on a suction stroke of pump 30 and closes on an exhaust stroke whereas valve 34 opens on an exhaust stroke of pump 30 and closes on a suction stroke.

The pumped liquid L leaving accumulator 38 passes through line 40 to a four-way connector 42. A suitable spray wand 44 connected to connector 42 and having a hand controlled valve control 46 serves to spray liquid L when valve 46 is open. Connector 42 also connects through line 52 to a manually operated on-off valve 50 and through line 62 to a pressure relief valve 60. When pump 30 is operative, valve 46 is closed and valve 50 is open, all of the pumped liquid can bypass through lines 52 and 54, tee connector 66 and line 15 to return to barrel 12 to stir the contents which is desirable for liquids with a relatively high solids content to facilitate later pumping. Alternatively, when valve 50 is closed the pressure relief valve 60 enables the pumped liquid L when above some preselected set relief pressure, e.g., 150 p.s.i., or when wand valve 46 is closed or when both conditions exist simultaneously to return through line 64,tee connector 66 and line 15 to barrel 12. Pressure relief valve 60 is selected or set, if adjustable, to have a relief pressure appropriate to the needs of the overall system and the character of the liquid L being pumped.

Making reference to FIGS. 2–5, pump 30 is illustrated as having a chamber C enclosed by a flexible metallic wall formed of thin, smooth, metal sheets, 70, 72 and 74 layered together. Chamber C is fitted with a removal drain plug 76 and a removable filler plug 78 for priming the pump. One side of pump 30 is secured to a fixed frame member 80 by means of a bolt 82 and nut 84. Bolt 82 passes through thin, smooth, circular metallic sheets or plate members 86, 88, 90 of increasing diameter which are mounted on the inside of bellows 30. Another pair of circular, thin, smooth, metal sheets or plate members 92, 94, of decreasing diameter are mounted between the outside of bellows 30 and the fixed frame member 80. Thus, the bellows wall made up of the layered sheets 70, 72 and 74 is effectively clamped between the set of sheets or plate members 86, 88, 90 and the opposite set of sheets or plate members 92, 94. While not illustrated in detail a similar construction is employed on the opposite side of bellows 30 and is clamped by a bolt 100 and nut 102.

Figure 3:
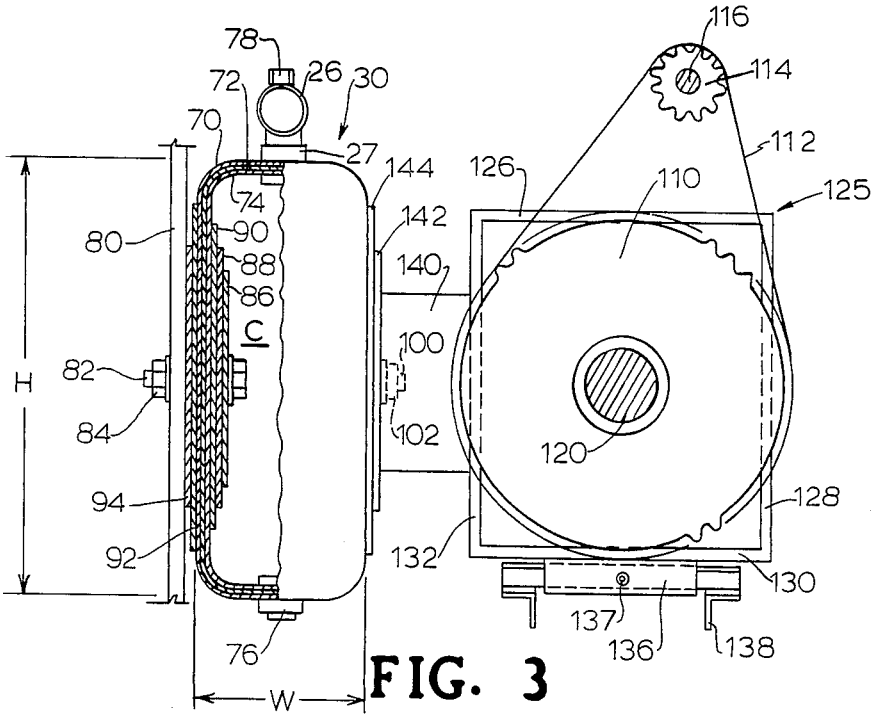
FIG. 3 is an elevation view of the pump apparatus with a portion of the invention pump broken away to illustrate the interior construction on one side which is duplicated on the opposite side.
Figure 4:
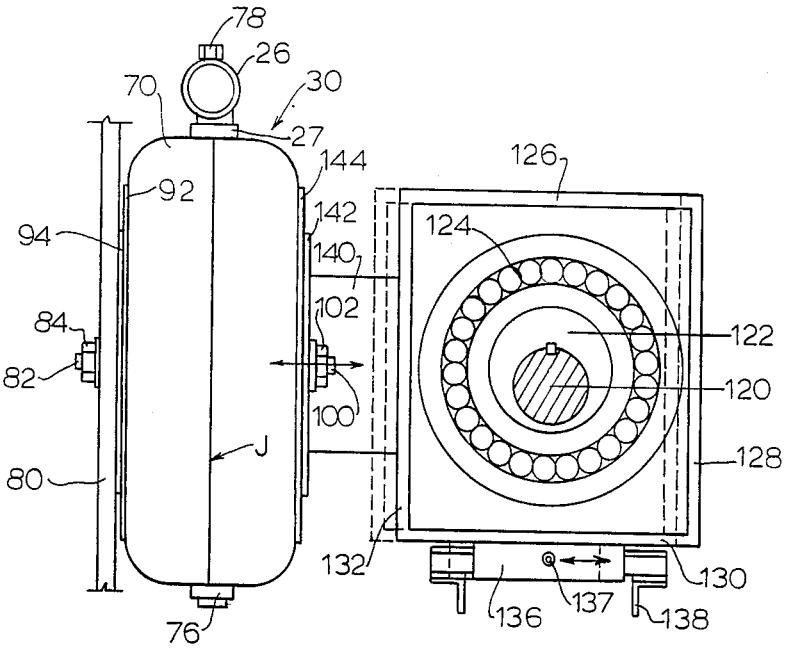
FIG. 4 is an elevation view illustrating in solid and dashed lines respectively the cam position in neutral and during compression of the invention pump for liquid discharge.
Figure 5:
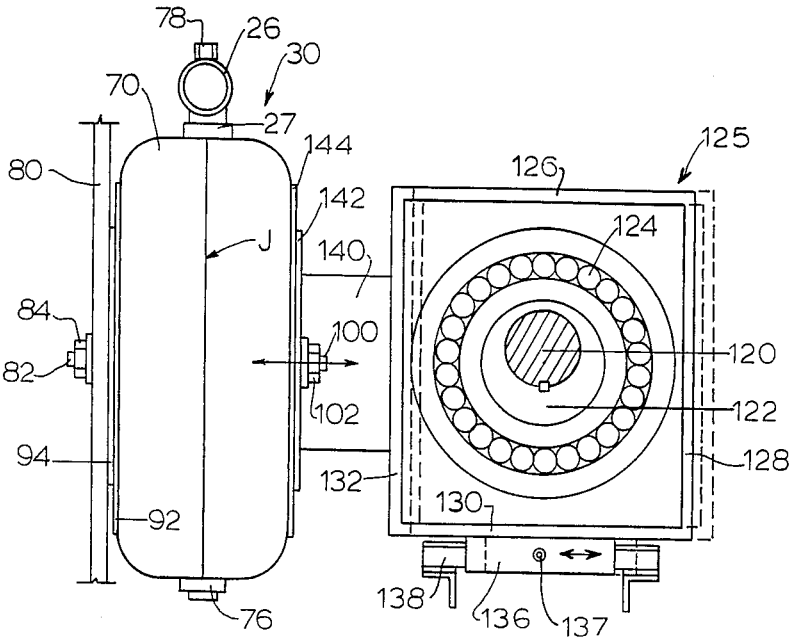
FIG. 5 is an elevation view illustrating in solid and dashed lines respectively the cam position in neutral and during an expansion or suction stroke of the invention pump.

A pumping action is achieved by effectively compressing and expanding the opposed sideways of bellows 30 in and out which effects a corresponding compression and expansion in the chamber C enclosed by the wall structure. Any suitable mechanism can be used for this purpose. In the illustrated embodiment, both liquid entry and discharge take place through the single pump opening communicating with line 27. An illustrative pumping mechanism employs sprocket 110 which is driven through chain 112 by sprocket 114 mounted on drive shaft 116 (FIG. 3). Shaft 116 is driven by a suitable power source such as a gasoline engine or the like, not shown. Sprocket 110 is rigidly secured to a drive shaft 120. Shaft 120 in turn rigidly mounts a cylindrical mounting block 122 in a hole formed in block 122 on an axis offset from the central axis of block 122. A bearing, such as a roller or sleeve bearing 124 mounts on the cylindrical mount 122. Bearing 124 in turn mounts within an integral four-sided metal frame 125 having a respective top bearing bar 126, rear bearing 128, bottom bearing bar 130, and front bearing bar 132. The described frame 125 mounts on a guide member 136 fitted with grease fitting 137, which slides back and forth on fixed support structure 138. Thus, it will be seen that as shaft 120 rotates, block 122 also rotates and causes bearing 124 to move frame 125 back and forth as indicated by the dashed line positions in FIGS. 4 and 5 and causes the opposed relatively flat sidewalls of pump 30 to also move in and out in corresponding amounts to create suction and pressure effects within chamber C.

Frame 125 is rigidly secured to a drive member 140, which in turn is rigidly secured to the thin, circular metal plate 142 which bears against the larger, thin, circular metal plate 144 on the outside of bellows 30 and is secured to bellows 30 by means of the bolt 100 and nut 102 previously referred to. Thus, whenever shaft 116 is driven by a suitable source of power, not shown, the opposed walls of the bellows 30 tend to be flexed in and out and thus create a corresponding pressure and suction effect which produces the desired pumping action.

In one embodiment the dimensions H and W (FIG. 3) were approximately 10" and 3¼" respectively. Each side of the bellows moved approximately ¼" in, and ¼" out, during a full pumping cycle. A 3-horse power gasoline engine was employed and sprocket 110 was driven at approximately 150 r.p.m. The laminated wall members 70, 72 and 74 were formed of 0.045" thick stainless steel sheet. The two sides of the bellows were separately formed by pressing the walls in cup-like shapes and then welding the assembled cup-like walls together along join line J to form the chamber C. Plates 86, 88 and 90 also formed of stainless steel were 0.09" thick and were respectively 4", 5", nd 6" in diameter. Plate 92 was 0.09" thick and was 7" in diameter. Plate 94 was 0.187" in thickness and was 5" in diameter. Plates 92, 94 were also made of stainless steel. The pump was primed using filler plug 78 by filling the chamber C with any suitable, available liquid. A maximum pressure of about 300 p.s.i. was obtained. The relief valve 60 was set at 150 p.s.i. It was found that when using less liquid through the spray wand 44 than was being pumped by the pump 30 and when the relief valve 60 was set at an appropriate relief pressure, a quantity of pumped liquid was constantly returned to the barrel 12 which produced a desirable stirring action in the barrel. This was found to be particularly desirable when pumping liquids having a solid content of 10–40%. When valve 50 was open approximately 10 gallons per minute was recirculated to barrel 12 and when wand valve 46 was open approximately 4 to 5 gallons per minutes was pumped through wand 44. A wide variety of normally abrasive and normally difficult to pump fluids were tried and were pumped successfully over a substantial period of time without breakdown. The pumping system was easily cleaned by withdrawing the suction line 16 from the barrel 12 and allowing the pump 30 to pump air to the various lines and fittings which it did successfully. Excess fluid was drained from the pump 30 utilizing the drain plug 76. The invention pump 30 was found particularly useful in pumping liquids with a relatively high solids content, such as sealing and curing compounds used in concrete work, on bridges, decks and the like.

Figure 6:
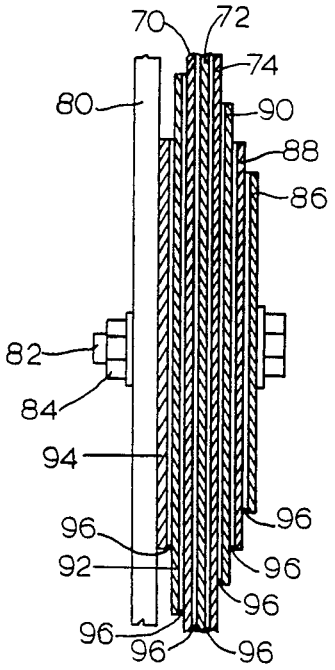
FIG. 6 is an enlarged cross section of a portion of FIG. 3 indicating the optional use of a sealing compound or layer between the metal sheets and plates shown in FIG. 3.

The thin, metallic, multi-layer pump wall exhibits an apparent slipping action between the individual wall sheets during pumping and such characteristic apparently contributes to the relatively long life achieved. Thus, it is deemed desirable not to laminate, e.g., by welding, glue or otherwise, or secure the individual sheets together except at the join line J. It also appears that by clamping the multi-layer wall formed of thin metal sheets between the internal thin metal sheets, e.g., sheets 86, 88 and 90 of different diameter, and the external thin metal sheets, e.g., sheets 92 and 94, also of different diameter, substantial resistance to cracking of the metal wall is achieved. It is contemplated however that with availability of the proper thin and flexible fatigue resistant sheet metal, pump 30 could be formed with a flexible wall of a single thin metal sheet and exhibit a substantially long life. One such embodiment was made with available thin, stainless steel sheet and was successfully tested with abrasive fluid. While exhibiting a wear life substantially longer than many other type pumps, the wear life was substantially less than that achieved with the described multi-layer type thin wall as in FIG. 3. Also contemplated is the use of a sealing compound such as a tire sealing compound, a thin rubber sheet or the like, indicated by numeral 96 in FIG. 6, between each layer of metal in the pump wall shown in FIG. 3, to seal cracks when they appear to prevent or at least reduce leaking and thus even further extend the life between pump breakdowns. Such sealing compound or sealing layer could also be employed between the external and internal plates, e.g., 86, 88, 90 and 92, 94. What has been achieved is thus a pump that under tests to date outlasts all types of pumps known to applicant as being currently available on the market for pumping abrasive liquids. Operating the pump at a relatively short stroke, e.g., ½", and relatively low frequency, i.e., 300 strokes per minute, has also provided sufficient volume for the applications intended.

What is claimed is:

1. A pump comprising:

(a) a flexible, substantially thin smooth metal wall structure, formed from a plurality of mated thin sheets of metal, with integrally joined opposed cup-shaped portions forming a hollow cylindrical chamber surrounded by said wall structure with at least one opening providing access thereto;

(b) means to compress and expand opposed sides of said wall structure to effect a corresponding compression and expansion of said chamber and thereby create a pumping action through said opening;

(c) conduit means connected to said opening and establishing a pump inlet and pump outlet and having one way valve means associated therewith to control flow therethrough;

(d) said wall structure being formed such that said chamber is defined by opposed relatively flat walls curved around to form said opposed cup-shaped portions;

(e) said opposed flat walls each mounting plural, thin, metal plate members both internal and external of said chamber;

(f) each respective said flat wall mounting a fastener passing through the respective flat wall and the respective opposed internal and external plates mounted thereon and operative to clamp together on opposite sides of the respective said flat wall the respective opposed external and internal plates mounted thereon; and (g) one of said flat walls being fixedly secured and the other of said flat walls being secured to move with said means to compress and expand said structure.

2. A pump as claimed in claim 1 wherein said sheets of metal are unsecured one to the other over a major portion of their mated surface area.

3. A pump as claimed in claim 1 wherein:

(a) the diameter of said internal plate members increases from the innermost to the outermost thereof; and (b) the diameter of said external plate members increases from the outermost to the innermost thereof.

4. A pump as claimed in claim 1 wherein each said fastener comprises a bolt and nut type fastening means.

5. A pump as claimed in claim 1 including sealing means interposed between selected of said wall structure sheets, internal and external plates and operative to seal cracks formed therein.

6. A pump system comprising:

(a) a source of liquid to be pumped;

(b) a pump comprising:

(i) a flexible substantially thin smooth metal wall structure with integrally joined cup shaped portions forming a hollow cylindrical chamber surrounded by said wall structure with at least one opening providing access thereto;

(ii) means to compress and expand said structure to effect a corresponding compression and expansion of said chamber and thereby create a pumping action through said opening;

(c) receiving means for receiving and utilizing the liquid pumped by said pump;

(d) one-way valve means on both the intake and discharge sides of said pump and arranged to enable said pump to suck liquid from said source on each expansion of said structure and discharge fluid from said pump to said receiving means on each compression of said structure;

(e) pressure relief means connected to the discharge side of said pump on one side and to said liquid source on the opposite side and adapted under a predetermined pressure to return said liquid to said source;

(f) bypass piping and manual valve means operative for returning all the discharge from said pump to said source to stir the contents therein;

(g) said metal wall structure comprising plural thin sheets of metal mated and joined to form said chamber;

(h) said wall structure being formed such that said chamber is defined by opposed relatively flat walls curved around to form said opposed cup shaped portions;

(i) said opposed flat walls each mounting plural, thin, metal plate members both internal and external of said chamber;

(j) each respective said flat wall mounting a fastener passing through the respective flat wall and the respective opposed internal and external plates mounted thereon and operative to clamp together on opposite sides of the respective said flat wall the respective opposed external and internal plates mounted thereon; and (k) one of said flat walls being fixedly secured and the other of said flat walls being secured to move with said means to compress and expand said structure.

* * * * *

UNITED STATES PATENT AND TRADEMARK OFFICE

CERTIFICATE OF CORRECTION

PATENT NO. : 4,753,578

DATED : June 28, 1988

INVENTOR(S) : Donald R. Morrison

It is certified that error appears in the above-identified patent and that said Letters Patent is hereby corrected as shown below:

Column 1, Line 30 correct "at" to read --or--.

Signed and Sealed this

Seventh Day of February, 1989

*Attest:*

DONALD J. QUIGG

*Attesting Officer*

*Commissioner of Patents and Trademarks*